US006942468B2

(12) United States Patent
Sauerbier et al.

(10) Patent No.: US 6,942,468 B2
(45) Date of Patent: Sep. 13, 2005

(54) PORTABLE HYDRAULIC PUMP UNIT

(75) Inventors: Carsten Sauerbier, Furth (DE); Uwe Kirchner, Marloffstein (DE); Heinz Heller, Erlangen (DE)

(73) Assignee: Lukas Hydraulik GmbH, Erlangen (DE)

( * ) Notice: Subject to any disclaimer, the term of this patent is extended or adjusted under 35 U.S.C. 154(b) by 105 days.

(21) Appl. No.: 10/297,798

(22) PCT Filed: May 26, 2001

(86) PCT No.: PCT/DE01/02008

§ 371 (c)(1),
(2), (4) Date: Dec. 9, 2002

(87) PCT Pub. No.: WO01/96742

PCT Pub. Date: Dec. 20, 2001

(65) Prior Publication Data

US 2004/0037709 A1 Feb. 26, 2004

(30) Foreign Application Priority Data

Jun. 16, 2000 (DE) ..... 100 28 957

(51) Int. Cl.[7] ..... F04B 17/00; F04B 53/00; F04B 39/00

(52) U.S. Cl. ..... 417/411; 417/234; 417/572

(58) Field of Search ..... 417/63, 234, 411, 417/410.1, 423.15, 423.14, 423.1, 424.2, 435, 572

(56) References Cited

U.S. PATENT DOCUMENTS 2,520,559 A 8/1950 Osius
3,945,610 A * 3/1976 Solie et al. ..... 254/93 R
4,235,542 A * 11/1980 Paterik, Jr. ..... 254/423
4,770,613 A * 9/1988 Hoover et al. ..... 417/411
5,360,322 A 11/1994 Henein et al.
5,678,982 A * 10/1997 Schwaiger ..... 417/44.2
5,727,417 A * 3/1998 Moffatt et al. ..... 72/453.03
5,971,727 A 10/1999 Horan et al.
6,092,290 A * 7/2000 Vogelsanger ..... 30/228
6,094,773 A * 8/2000 Krentz et al. ..... 15/321
6,282,893 B1 * 9/2001 Porter et al. ..... 60/477

FOREIGN PATENT DOCUMENTS

DE 43 23 574 C1 11/1994
DE 43 20 692 A1 1/1995
DE 195 13 286 A1 10/1995
DE 196 35 411 A1 3/1998
DE 299 06 881 U 1 8/1999
DE 299 16 230 U1 2/2000
EP 0 940 578 A1 9/1999

* cited by examiner

*Primary Examiner*—Cheryl J. Tyler
*Assistant Examiner*—Timothy P. Solak
(74) *Attorney, Agent, or Firm*—Merchant & Gould P.C.

(57) ABSTRACT

The invention relates to a portable hydraulic pump unit (1) comprising a housing (2), a pump (5), a drive motor (6) for the pump (5), in particular in the form of an electric drive motor, in addition to a reservoir (13) for hydraulic fluid. According to the invention, the housing (2) is tubular and (when viewed in cross-section) point symmetrical, e.g. cylindrical, square, triangular or polygonal. The advantage of the hydraulic pump unit is that is can be positioned and transported in the receptacles of conventional portable tank carriers, in particular for the tanks of protective breathing apparatus.

16 Claims, 3 Drawing Sheets

PORTABLE HYDRAULIC PUMP UNIT

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

FIELD OF THE INVENTION

The present invention relates to a portable hydraulic pump unit comprising a housing, a pump, a drive motor for the pump, in particular in the form of an electric drive motor, as well as a reservoir for hydraulic fluid.

BACKGROUND OF THE INVENTION

Portable hydraulic pump units are already known from the prior art. They serve to operate certain work tools, for example cutting equipment or spreading devices for on-the-spot rescue use. Conventional hydraulic pump units are designed so as to be carried and set down on the ground at the application spot by means of a handle. Thereby, however, these units have the disadvantage that the freedom of movement of the operator is negatively affected, since the operator must change the location of the hydraulic pump unit in each case upon a position change. Thus, the technical problem consists in the fact that conventional hydraulic pump units, despite their portability, ensure only an inadequate handling.

BRIEF SUMMARY OF THE INVENTION

The task of the present invention consists in making available a portable hydraulic pump unit with a significantly improved handling.

This task is accomplished, in the above-specified generic hydraulic pump unit, in that an elongated housing is provided, which housing has a tubular shape. By this means, it becomes possible to position or transport the hydraulic pump unit on the back of the respective operator in the receptacles of conventional carriers for tanks, in particular for tanks for breathing apparatuses.

Advantageously, the housing—viewed in cross section—has a point-symmetrical shape, in particular a circular, square, triangular, or polygonal shape. Of these, the circular shape is especially preferable.

In the latter case, the external diameter of the housing is appropriately within the range of 150 mm to 220 mm.

In order to ensure a good handling and transportability, according to a further development of the present invention a carrying handle is provided on at least one, preferably both end walls, which carrying handle is sunk below the plane of the end wall. The ability to handle and position the hydraulic pump unit is therefore not negatively affected by the carrying handle or handles.

Appropriately, the carrying handle is located inside of a sealing cap that extends into the housing. In this case, the carrying handle serves, on the one hand, as a carring aid, and on the other hand as a handle for unscrewing the sealing cap.

A further development of the present invention is characterized in that the housing comprises two housing sections, and further that a valve plate is provided, which valve plate is arranged between the two housing sections.

Resulting from this is an improved accessibility of the housing interior on both sides of the valve plate, since the valve plate forms, so to speak, a separation plane of the housing. This is of particular advantage precisely in the case of the striven-for slender shape of the housing.

Appropriately, the valve plate is simultaneously a support plate for certain components of the hydraulic pump unit, as for example the drive motor, the pump, and the two housing sections.

It is further appropriate to arrange the drive motor, the pump, and the reservoir for the hydraulic fluid axially one behind another.

According to one arrangement of the invention, the reservoir is equipped with a flexible wall or at least with a flexible membrane, whereby volume differences in the tank caused by operation can be equalized.

Appropriately, the flexible wall can be designed as a cylindrical wall provided with a corrugated outside contour. The corrugation of the outside contour makes possible a simplified volume equalization.

Alternatively, the reservoir can also display a fixed volume and, at the same time, be provided with a ventilation and/or exhaust means (22).

Further, the pump and the reservoir can be arranged immediately against each other, whereby supply lines can be avoided and consequently the structure can be simplified.

An arrangement of the invention is further characterized in that, at least over a section of the length of the housing, and preferably over at least half the length, no parts are present which protrude beyond the outer contour of the housing. Through this, the insertability of the hydraulic pump unit into the relevant carriers is facilitated. The only exceptions to this are attachment parts that possibly protrude beyond the outer contour. This is true in particular of that section of the housing located at the underside of the valve plate.

Switches for operating the hydraulic pump and/or control devices are appropriately provided in the base of the sealing cap, preferably the upper sealing cap, and therefore do not protrude.

Preferably, the two housing sections are unequally long. In particular, the one housing section serves to hold the drive motor, while the other housing section designed with shorter length serves to hold the pump, the reservoir, and the sealing cap, the latter possibly including switches and/or control devices. In this way, an optimal adaptation to the length of the individual components is achieved, resulting in a minimal overall length despite the slender shape.

Appropriately, one sealing cap, preferably the lower sealing cap, is designed as a quick seal, i.e. it can be removed with a simple turning if need be.

Further, one sealing cap, preferably the upper sealing cap, can be appropriately designed as a fixed sealing cap.

An arrangement of the present invention is characterized in that at least one connecting element is positioned at the valve plate. Should the hydraulic pump unit be used for a double-action cylinder system, then alternatively two connecting elements can be provided in the region of the valve plate, one for the high-pressure piping and the other for the return piping.

BRIEF DESCRIPTION OF THE SEVERAL VIEWS OF THE DRAWINGS

In the following, an advantageous arrangement of the hydraulic pump unit according to the invention is explained in detail with the aid of the drawn figures. They show.

Figure 1:
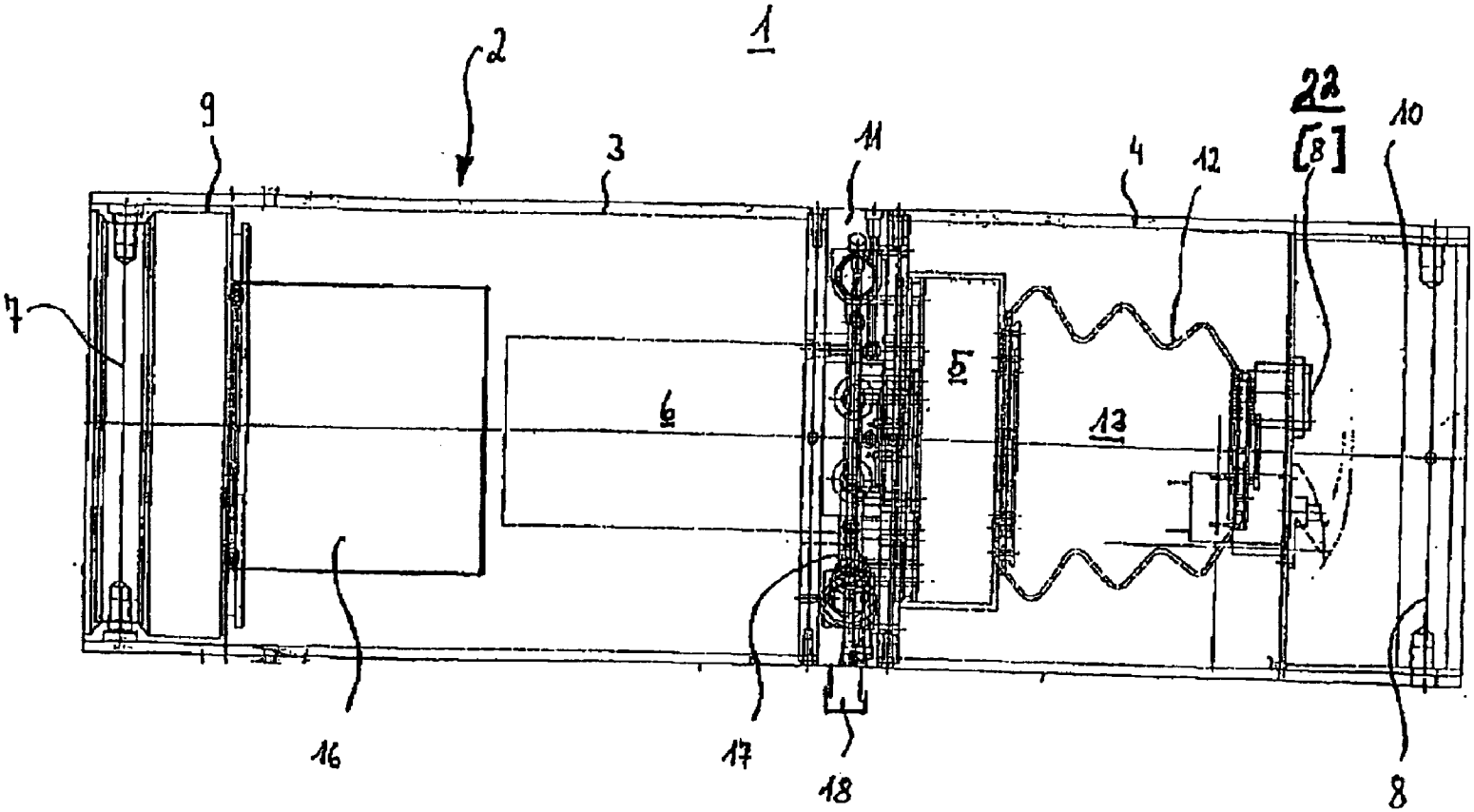
FIG. 1: a longitudinal-section representation through the complete hydraulic pump unit.
Figure 2:
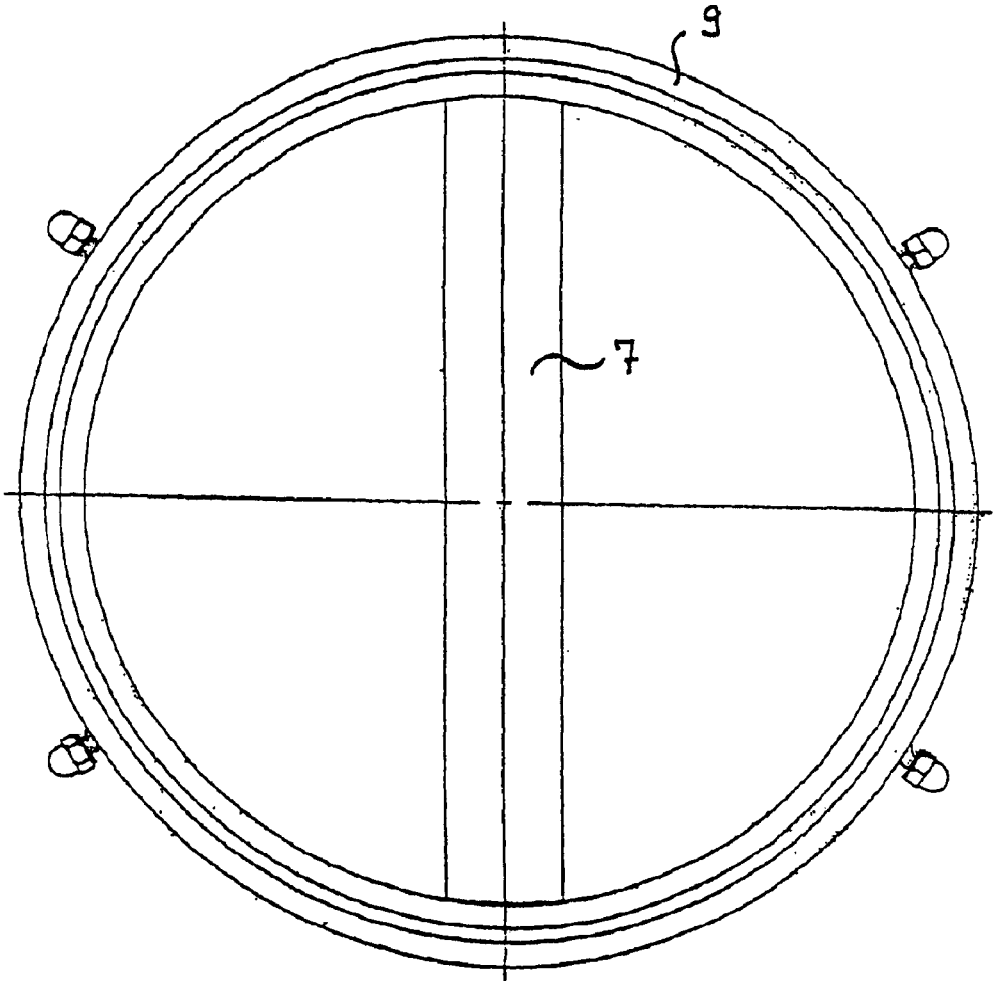
FIG. 2: a lower end wall view of the hydraulic pump unit according to claim 1.
Figure 3:
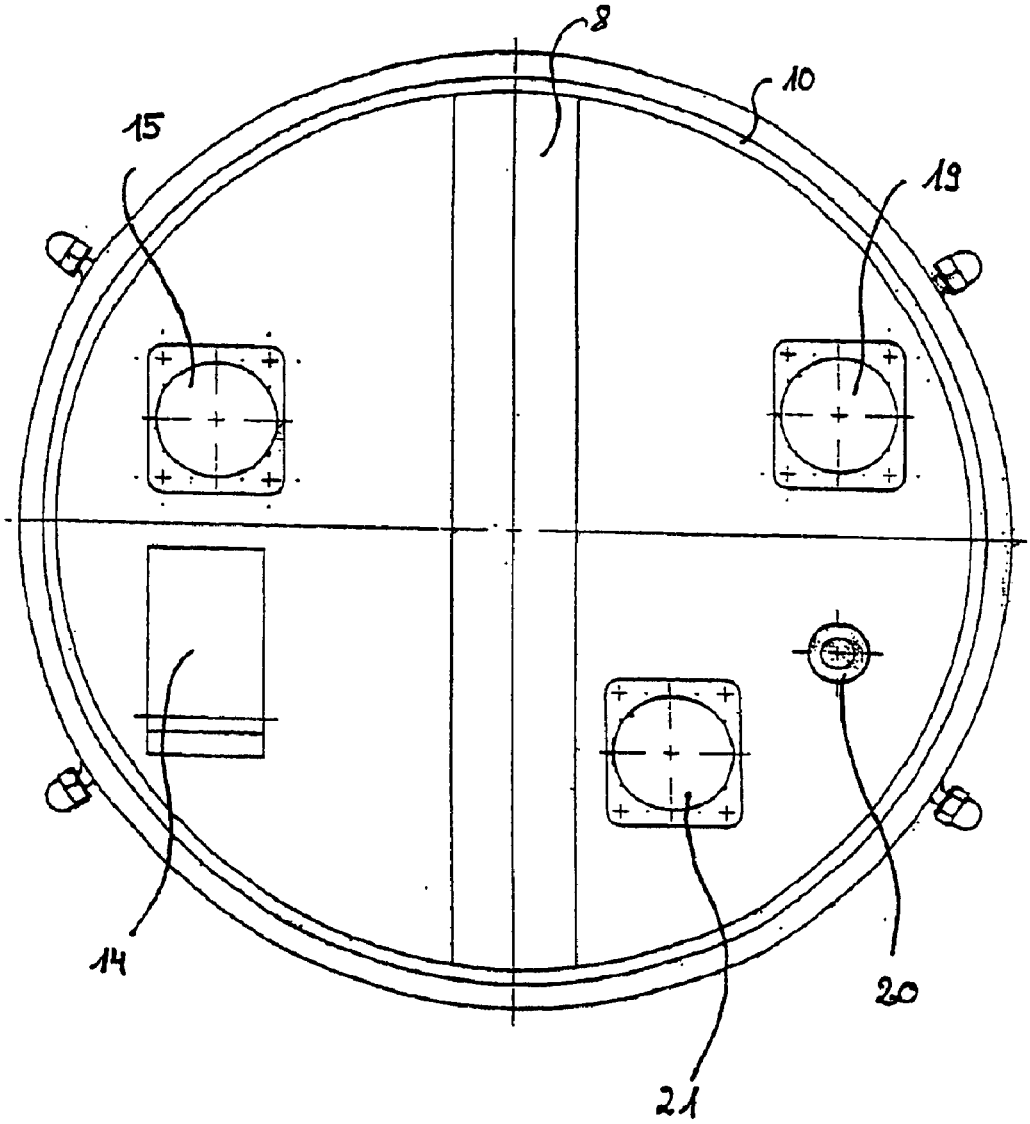
FIG. 3: an upper end wall view of the hydraulic pump unit according to FIG. 1.

Reference numeral 1 in FIG. 1 indicates the hydraulic pump unit according to the invention in its entirety. The unit comprises a slender, elongated cylindrical housing 2, which is sealed at the lower end wall (left side in FIG. 1) and at the upper end wall (right side in FIG. 1) in each case by means of a sealing cap 9 or 10 respectively. The hydraulic pump unit thus has the appearance of a cylindrical pipe that contains the collective functional units.

Appropriately, the housing 2 has an outer diameter of 150 mm to 220 mm. Of course, other dimensions, specific to the application, are also possible. The housing is composed of two housing sections 3 and 4, which are supported by a valve plate 11 arranged between them. The valve plate 11, due to its disc shape, completes, so to speak, the total unit. Inside the valve plate 11 are located different functional valves, as for example a pressure reversing valve (low pressure/high pressure, pressure relief valve, as well as pressure limit valve), which is not shown in detail. Further, provided on the valve plate 11 is a connecting element 18 for the connection to the appliance. If necessary, two connecting elements 18 can be provided on the valve plate 11 for a high-pressure piping as well as a return piping in double-action systems.

Immediately at the top of the valve plate 11 is located the pump 5, which is driven by a drive motor 6, in particular an electric drive motor, that is arranged on the opposite side of the valve plate 11. In the second housing section 3 a rechargeable battery 16 is situated between the sealing cap 9 and the drive motor 6. Alternatively to this, the rechargeable battery 16 can—if necessary—be provided outside the hydraulic pump unit. At the top of the pump 5 is located the reservoir 13 for the hydraulic fluid, i.e. the hydraulic tank.

The wall of the reservoir is designed in the form of a flexible wall 12 in order to be able to equalize volume differences inside the reservoir caused by operation. The flexible wall 12 is provided with a cylindrically-encircling corrugation that facilitates the volume equalization.

In the region of the lower end wall, the sealing cap 9 mentioned in the introduction can be screwed in or out as a manually-actuated quick seal. Serving this purpose is the carrying handle 7 that is sunk into the housing 2 across the end-surface plane. Due to this quick seal, the rechargeable battery 16 is easily accessible.

The lower housing section 3 that holds the drive motor 6 and the rechargeable battery 16 is longer than the other, upper housing section 4.

The opposite, upper sealing cap 10 is fixedly attached in the housing 2. This cap likewise has a carrying handle 8, which is sunk into the end wall plane across the latter.

Arranged at the bottom of the sealing cap 10 is a switching apparatus 14 for operating the hydraulic pump unit 1 as well as a control device (display) 15. In addition, located in the region of the bottom of the sealing cap 10 is an external charge socket 19 for external energy, an electric circuit breaker 20, as well as a power line charge socket 21 for the rechargeable battery 16.

The hydraulic pump unit according to the invention, first, ensures a reliable protection of the collective functional units inside the elongated, cylindrical housing, and second, the hydraulic pump unit is easy to handle and has the particular advantage that it can be held in the receptacles of conventional carriers for tanks, especially tanks for breathing apparatuses, which carriers are normally carried on the back of the operator.

The operator thus has the hydraulic pump unit constantly with him and can carry out operations without having to change the position of the hydraulic pump unit.

The present invention consequently represents a completely unique contribution to the relevant technical field.

Reference Numeral List

1 hydraulic pump unit
2 housing
3 housing section
4 housing section
5 pump
6 electric motor
7 carrying handle
8 carrying handle
9 sealing cap
10 sealing cap
11 valve plate
12 flexible wall
13 reservoir for hydraulic fluid
14 switch
15 control device
16 rechargeable battery
17 slide valve
18 connecting element
19 external charge socket
20 electric fuse element
21 power line charge socket
22 ventilation and/or exhaust

What is claimed is:

1. Portable hydraulic pump unit (1) for operation of interchangeable work tools for on-the-spot rescue use, with a housing (2), a pump (5), an electric drive motor (6) for the pump (5), a reservoir (13) for hydraulic fluid, the housing (2) has a pipe-like shape and comprises two housing sections (3, 4), a valve plate (11) is provided, which plate is located between the two housing sections (3, 4) and supports the drive motor, the pump (5) as well as the housing sections (3, 4), with the reservoir (13), the pump (5), the drive motor and a rechargeable battery (16) being arranged axially one behind another in the housing (2), said portable hydraulic pump unit (1) further comprises a first connecting element (18) for high pressure piping and a second connecting element (18) for return piping, wherein the high pressure piping and the return piping are connectable to said work tools.

2. Hydraulic pump unit according to claim 1, wherein the housing, viewed in cross section, displays a point-symmetrical shape.

3. Hydraulic pump unit according to claim 1, wherein the outer diameter of the housing is in the range of 150 mm to 220 mm.

4. Hydraulic pump unit according to claim 1, wherein the hydraulic pump unit (1) can be inserted into the receptacles of conventional carriers for tanks for breathing apparatuses.

5. Hydraulic pump unit according to claim 1, wherein the reservoir (13) is provided with a flexible wall (12) or a flexible membrane.

6. Hydraulic pump unit according to claim 5, wherein the flexible wall (12) has a cylindrical, corrugated outer contour.

7. Hydraulic pump unit according to claim 1, wherein the reservoir displays a fixed volume and is provided with a ventilation component.

8. Hydraulic pump unit according to claim 1, wherein the pump (5) and the reservoir (13) are arranged immediately against each other.

9. Hydraulic pump unit according to claim 1, wherein at least half of the total length of the housing, no parts are present that protrude over the outer contour of the housing.

10. Hydraulic pump unit according to claim 1, wherein the two housing sections (3, 4) are unequally long.

11. Hydraulic pump unit according to claim 1, wherein provided on at least one end wall, is a carrying handle (7, 8) sunk below the end wall plane.

12. Hydraulic pump unit according to claim 11, wherein the carrying handle (7 or 8) is located in the interior of a sealing cap (9 or 10) that extends into the housing.

13. Hydraulic pump unit according to claim 12, wherein switches (14) or control devices (15) are provided in the bottom of the sealing cap (9 or 10).

14. Hydraulic pump unit according to claim 12, wherein one sealing cap (e.g. 9) is designed as a quick seal.

15. Hydraulic pump unit according to claim 12, wherein another sealing cap (10) is designed as a fixed cap.

16. Hydraulic pump unit according to claim 15, wherein at least one connecting element (18) is positioned at the valve plate (11).

* * * * *